United States Patent [19]

Wong

[11] 4,215,531

[45] Aug. 5, 1980

[54] WATCHES

[76] Inventor: Hon W. Wong, Ting Kau, New Territories, Hong Kong

[21] Appl. No.: 852,832

[22] Filed: Nov. 18, 1977

Related U.S. Application Data

[63] Continuation-in-part of Ser. No. 727,494, Sep. 28, 1976, abandoned.

[51] Int. Cl.[2] ..... G04B 37/00

[52] U.S. Cl. ..... 368/10; 368/278; 368/82; 368/69

[58] Field of Search ..... 58/88 R, 88 E, 50 R, 58/152 R, 23 R, 57.5, 23 BA; D10/31, 2, 30; 235/64; 346/146

[56] References Cited

U.S. PATENT DOCUMENTS

| | | | |
|---|---|---|---|
| 1,709,700 | 4/1929 | Wishinsky | 58/88 R |
| 2,718,749 | 9/1955 | Florman | 58/152 R X |
| 3,538,703 | 11/1970 | Walton | 58/23 R |

*Primary Examiner*—Ulysses Weldon

*Attorney, Agent, or Firm*—Remy J. VanOphem

[57] ABSTRACT

The invention is a digital electronic watch housed within the same casing as a writing instrument. Terminals are disposed in proximity to the metallic pocket clip to provide an electrical contact to initiate the digital readout display which is housed in a section of the casing having a window for the readout display. The internal components of the writing instrument are constructed in a way to provide an unobstructed axial passage in the writing instrument for the writing and a retraction mechanism of the instrument to be used. The relationship of the means for energizing the display to the pocket clip are such that inadvertent actuation is avoided when carrying the writing instrument in a pocket.

12 Claims, 5 Drawing Figures

WATCHES

CROSS REFERENCE TO RELATED APPLICATION

This application is a continuation-in-part application of copending application Ser. No. 727,494, filed Sept. 28, 1976 now abandoned.

BACKGROUND OF THE INVENTION

The present invention relates to watches.

There have recently become available on the market electronic circuits for driving displays to provide a digital readout of the time. Such circuits rely on the oscillations of a quartz crystal and are inherently of extreme accuracy.

Hitherto, such circuits have been mounted in a case resembling that of a conventional mechanical wrist watch. However, because of the dimensions of the circuitry and more particularly of the power cells, such wrist watches have been bulky. Furthermore, the replacement of the cells needs to be effected by skilled personnel thereby increasing maintenance costs.

SUMMARY OF THE INVENTION

The present invention seeks to provide a digital watch mitigating at least some of the foregoing disadvantages.

In accordance with a first aspect of the present invention, there is provided a digital electronic watch housed within the elongate casing of a writing instrument.

In accordance with a second aspect of the present invention, there is provided a digital electronic watch housed within the elongate casing of a retractable writing instrument, in which a digital readout display of the watch and a circuit board supporting an electronic circuit for driving the display are arranged in planes inclined relative to one another within a portion of the casing intermediate the ends thereof in such a manner as to allow an unobstructed axial passage in the writing instrument for the writing and retraction mechanism.

Conveniently, the intermediate portion of the casing is of rectangular section having a window in the narrower side for the readout display.

Advantageously, power is supplied to the electronic drive circuit and the digital readout display panel from a pair of cells arranged in opposite longitudinal halves of the casing and electrically connected to one another by means of a common electrode which defines an axial passage for the writing and retraction mechanism. The writing mechanism, in the case of a ball point pen includes the refill and in the case of a propelling pencil includes a tube for the pencil leads.

In a preferred embodiment of the invention, the writing instrument has a metallic pocket clip a portion of which is resiliently deformable into electrical contact with a terminal connected to the circuit board of the electronic watch in order to energize the digital readout display.

Preferably, a second contact terminal is provided beneath the pocket clip for resetting the digital watch, resetting being effected by introducing a metal object in between the clip and the said second terminal to establish an electrical contact between the clip and the second terminal.

Conveniently, the terminals beneath the pocket clip are constituted by threaded screws serving to retain the circuit board and the display panel within the elongate casing.

Advantageously, the power cells are arranged adjacent the end of the writing instrument and are accessible by removal of a cap which incorporates an actuating button of the retraction mechanism, the cells being arranged in a portion of the elongate casing space from the intermediate portion incorporating the digital readout display and the watch circuitry by a section enclosing a retraction mechanism, electrical contact being made between the cells and the circuitry by means of a pair of flat metallic elongate strips extending in between the casing and the retraction mechanism.

The retraction mechanism may be similar to a conventional retraction mechanism in which a cam is arranged to be axially displaced by the retraction button and simultaneously to be rotated in each stroke by a predetermined angle, the cam having abutments to engage corresponding abutments within the casing such that with each depression of the retraction button the cam alternates between two predetermined axial positions defined by the said abutments.

BRIEF DESCRIPTION OF THE DRAWINGS

The invention will now be described further by way of example, with reference to the accompanying drawings, in which.

DESCRIPTION OF THE PREFERRED EMBODIMENTS

Figure 1:
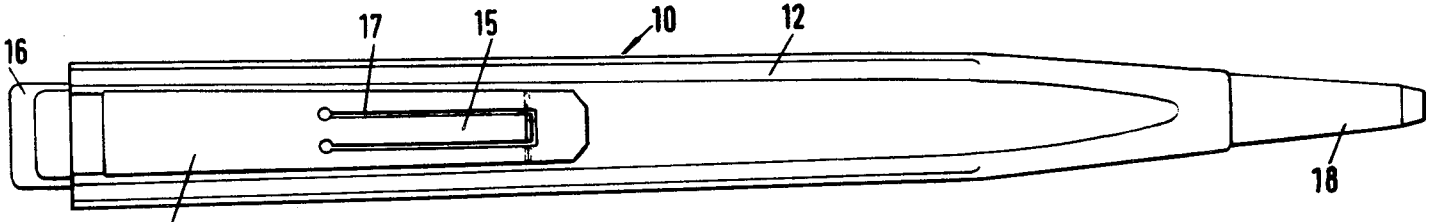
FIG. 1 is a plan view of a combined ball point and LED watch.
Figure 2:
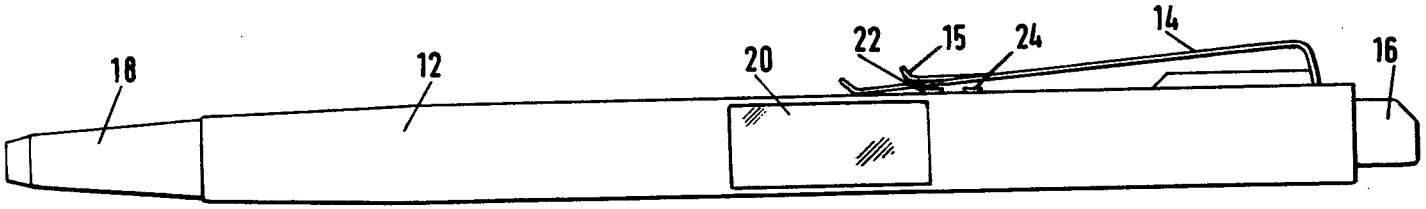
FIG. 2 is a side view of the watch in FIG. 1.

In FIG. 1, a ball point pen generally designated 10 has a casing 12, a pocket clip 14, a retraction button 16 and a screw-on finger grip 18. The casing has a generally rectangular shape and has a window 20 along its narrower side as shown in FIG. 2. The casing is not limited to this configuration and may be of any desired shape. The window 20 is arranged in front of a light emitting diode display housed within the casing of the pen. The clip 14 is formed with a U-shaped slot 17 which defines a resilient tongue 15 serving as an actuating button for the watch. Beneath the clip 14 there are arranged two contact terminals 22 and 24 and when contact is made between the tongue 15 and the contact 22 the watch is energized. The tongue 15 is, therefore, completely equivalent to the button provided on a conventional wrist mounted watch for displaying the time. If the tongue 15 is depressed once, the time is displayed as the hours and minutes. If the tongue is not released and maintained pressed, after a certain time, the display will change to indicate the seconds. Finally, if the tongue is depressed twice in rapid succession, the month and the day of the month are displayed. The "functions" naturally depend on the construction of the integrated circuit of the watch and there are several integrated circuit modules available on the market for driving a watch. The invention, therefore, is not limited to this particular sequence of functions.

The second contact 24 is arranged beneath the clip 14 and cannot normally touch the tongue 15 but an electrical contact may be established between the contact 24 and the clip 14 by insertion of a metal object. Establishing such a contact is equivalent to actuating the reset button on a conventional LED watch. When first electrical contact is made between the terminal 24 and the clip 14, a resetting program is initiated and the display indicates only the hour of the day. If the hour of the day is incorrect, then the tongue 15 is depressed whereupon the hour will change at one second intervals until the desired hour is reached. At this point, the next step in the resetting program is mae by again establishing contact between the terminal 24 and the clip 14. This time, the minutes are displayed and they may again be changed at one second intervals by depression of the tongue 15. The same process is then repeated for the day of the month and the month. Finally, when a contact is again made between the terminal 24 and the clip 14, a column on the display between the hours and the minutes flashes at one second intervals and ceases when the tongue 15 is depressed. This serves to reset the seconds count to zero.

The refill for the ball point pen is a standard refill extending substantially over the full length of the pen and is renewable by removal of the finger grip 18 which is screw threaded onto the front end of the pen. The refill may be extended and retracted by means of the retraction button 16 so that with the depression of the retraction button 16 the tip of the refill alternatively protrudes from and retracts into the pen.

Figure 3:
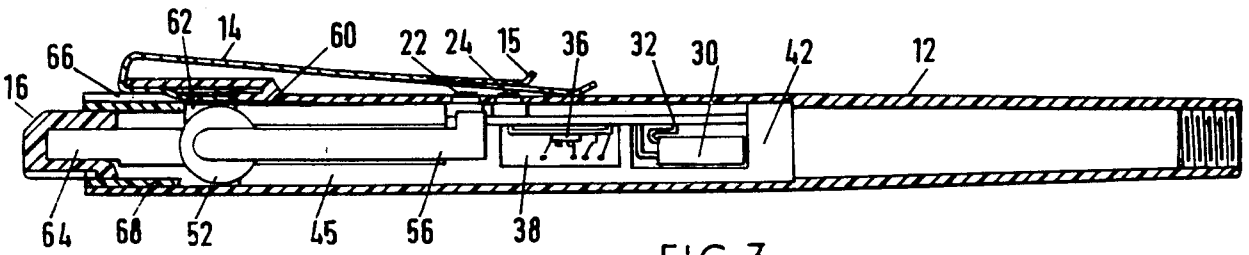
FIG. 3 is a side view in which a part of the casing has been cut away to expose the watch mechanism.

In FIG. 3, there is shown the pen with the casing cut away to expose the interior mechanism of the watch. The pen is also shown with the refill removed. The digital watch mechanism comprises an integrated circuit 30 mounted on a circuit board 32 which carries conductors on both sides. Such an integrated circuit is commonly available on the market and need only be connected to an external supply, a pair of switches (constituting the display and reset button), a quartz crystal and a trimmer capacitance in order to drive a light emitting diode display. In FIG. 3, as earlier described, the reset button and the display energizing button are constituted by the terminals 22 and 24 which are constructed as the heads of screws serving to maintain the watch mechanism within the casing 12. The switches for resetting and energizing the display are constituted by these terminals and the clip 14 which is also in electric contact with a terminal commonly connected to two cells, in a manner described below. The crystal and trimmer capacitance are designated 36 in the drawings and the light emitting diode display, itself readily available on the market, is mounted on a circuit board 38 extending at right angles to the circuit board 32. The light emitting diode display is not shown in FIG. 3 and is designated 40 in FIG. 4. It is believed that the assembly of a light emitting diode from the above components available on the market will be readily apparent to a person skilled in the art without further description.

Figure 4:
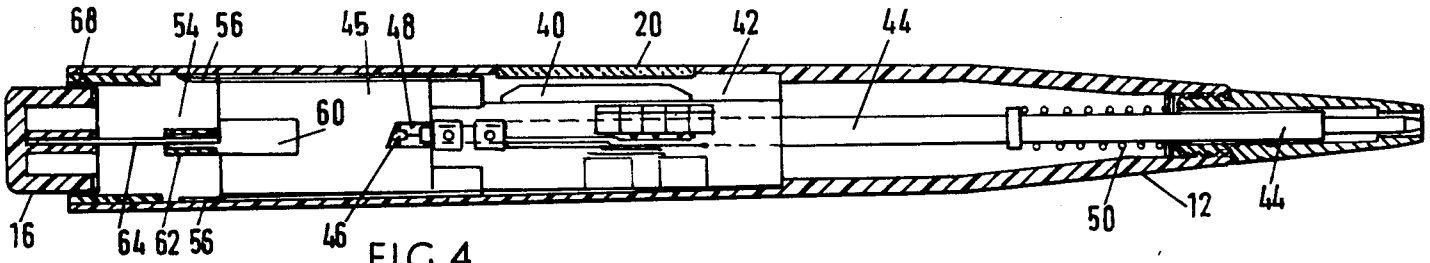
FIG. 4 is a plan view of the ball point pen with parts of the casing cut away.
Figure 5:
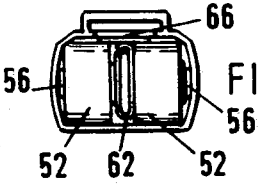
FIG. 5 is an end view of the pen with the retraction button removed to expose the cells.

The two circuit boards 32 and 38 extending at right angles to one another and supporting the integrated circuit 30, the quartz crystal, the trimmer capacitor 36 and the LED display 40 are supported on a plastic insert 42 which is hollow and allows an unobstructed axial passage for the refill which is designated 44 in FIG. 4. The integrated circuit 30 and the crystal and trimmer capacitor 36 are also mounted off axis so as not to interfere with the passage of the refill 44. The insert 42 is composed of two sections, the first serving to support the printed circuits of the LED watch and the second, designated 45, housing a conventional retraction mechanism. The retraction mechanism comprises a cam 46 which has radial projections engagable within a slot 48. With each depression of the retraction button 16, the cam 46 advances axially and at the same time rotates. Depending upon its angular position, a projection of the cam may or may not engage within the recess 48 and therefore the cam will rest in one of two axial end positions under the action of a biasing spring 50 of the refill 44. Once again it is pointed out that such a retraction mechanism is well known in the art and need not therefore be described in detail.

The cells 52 for the LED watch are arranged within a compartment 54 lying beyond the end of the retraction mechanism remote from the printed circuits 32 and 38. An electrical connection is made between the cells 52 and the circuit by means of two brass contact strips 56 which extend along side the section 45 of the insert 42 between the insert and the casing. The cells are connected in series with one another across the two strips 56 with adjacent electrodes connected to a common contact 60. The contact 60 is supported on the section 45 of the insert 42 and has a flattened annular portion 62 which contacts the two cells 52 and at the same time defines an unobstructed axial passage for a flat push rod 64 which is connected to the retraction button 16 and serves to displace the cam of the retraction mechanism axially. The annular portion 62 is also electrically connected to the clip 14 through a cut-away portion 66 of the casing.

The retraction button together with the push rod 64 is retained within the pen by means of a cap 68 which clips into the end of the pen. Upon withdrawal of the cap 68, the cells 52 may be inserted without disturbing or exposing the electrical circuitry.

An advantage of the pen resides in the fact that it can accommodate a refill 44 of conventional construction and length. A further advantage resides in the fact that the use of the clip 14 as part of an electrical switch for energizing and resetting the watch ensures that the watch is never energized when the pen is carried in a pocket.

The casing of the pen may either be of a metallic or of a plastic material. If a metal is used, an insulation layer is required to ensure that the contact strips 56 are not short circuited to one another.

Whilst the invention has been described by reference to a ball point pen, it is evident that the construction may readily be adapted to enable a watch to be incorporated within the same casing as a propelling pencil.

If desired, it is possible to incorporate within the pen an audible alarm device for producing an alarm at a preset time under the control of the digital watch. Such alarm devices are presently available and have been incorporated in wrist watches.

What is claimed is:

1. A digital electronic watch in combination with a writing instrument comprising:

means for dispensing a marking material, said means for dispensing including a dispenser at one end and an elongated storage receptacle for storing said marking material extending rearwardly from said dispenser, said dispenser adapted to be extended for writing and retracted for storage;

a hollow elongated casing having a tapered end and an open end, said tapered end having said means for dispensing attached thereto with said elongated storage receptacle axially disposed inside said casing, said casing further having an insert compartment formed therein, said insert compartment extending a predetermined distance into said casing from said open end, and a window disposed between said predetermined distance and said open end;

digital watch insert means disposed in said insert compartment for generating a visual time display through said window, said watch insert means having an axial passageway permitting said elongated storage receptacle to pass partway therethrough and a mechanical means disposed at the end of said axial passageway, said mechanical means engaging the end of said elongated storage receptacle and operative to extend and retract said dispenser; and cap means disposed to close the open end of said casing, said cap means including a mechanical actuator coupled to said mechanical means, actuation of said mechanical actuator operative to cause said mechanical means to extend and retract said means for dispensing.

2. The combination of claim 1 wherein said digital watch insert comprises:

a rigid insert member having a first section having said axial passageway passing therethrough and a second section embodying said mechanical means therein, said second section further including a battery compartment at the rearward end thereof;

at least one battery disposed in said battery compartment;

digital watch circuit means for generating digital signals indicative of the time, said digital watch circuit disposed on said first section and receiving electrical power from said battery;

digital display means for generating numbers indicative of said digital signals received from said digital watch circuit means in an activated state, said digital display means disposed on said first section adjacent to said window and visible therethrough; and switch means connected between said battery and said display means for activating said display means in a closed state.

3. The combination of claim 1 wherein said insert chamber and the portion of the casing forming said insert chamber have a rectangular configuration, and wherein said window is disposed along one of the narrower sides of said rectangular configuration.

4. The combination of claim 2 wherein said battery compartment houses two batteries connected in series.

5. The combination of claim 4 wherein said digital watch circuit means comprises at least two circuit boards mounted on said first section and disposed in planes inclined relative to each other, one of said circuit boards having an integrated circuit mounted thereon and the other circuit board having an oscillating crystal, a trimmer capacitor and said display means mounted thereon.

6. The combination of claim 2 further including a deformable metal pocket clip attached to said casing and connected to one terminal of said battery, and a first electrical contact disposed on said casing beneath said pocket clip and connected to said display means, wherein said metal pocket clip and said first electrical contact comprises said switch means activating said display means when said pocket clip is deformed by finger pressure to contact said electrical contact.

7. The combination of claim 6 wherein said digital watch circuit means further includes reset circuit means for resetting the time of said digital watch circuit means, said combination further including a second electrical contact disposed on said casing beneath said pocket clip and connected to said reset circut means, wherein contact of said pocket clip with said second electrical contact actuates said reset circuit means.

8. The combination of claim 7 wherein said first and second electrical contacts are conductive threaded screws fixedly securing said insert member in said rigid insert compartment.

9. The compartment of claim 2 wherein said cap means is removable to permit replacement of said battery.

10. The combination of claim 1 wherein said means for dispensing is a commercially available ball point pen cartridge.

11. A digital electronic watch in combination with a writing instrument comprising:

means for dispensing a marking material, said means for dispensing including a dispenser at one end and an elongated storage receptacle for storing said marking material extending rearwardly from said dispenser, said dispenser adapted to be extended for writing and retracted for storage;

a hollow elongated casing having a tapered end and an open end, said tapered end having said means for dispensing attached thereto with said elongated storage receptacle axially disposed inside said casing, said casing further having an insert compartment formed therein, said insert compartment extending a predetermined distance into said casing from said open end, and a window disposed between said predetermined distance and said open end;

digital watch insert means disposed in said insert compartment for generating a visual time display through said window, said watch insert means having an axial passageway permitting said elongated storage receptacle to pass partway therethrough and a mechanical means disposed at the end of said axial passageway, said mechanical means engaging the end of said elongated storage receptacle and operative to extend and retract said dispenser;

cap means disposed to close the open end of said casing, said cap means including a mechanical actuator coupled to said mechanical means, actuation of said mechanical actuator operative to cause said mechanical means to extend and retract said means for dispensing;

wherein said digital watch insert comprises:

a rigid insert member having a first section having said axial passageway passing therethrough and a second section embodying said mechanical means therein, said second section further including a battery compartment at the rearward end thereof;

at least one battery disposed in said battery compartment;

digital watch circuit means for generating digital signals indicative of the time, said digital watch circuit disposed on said first section and receiving electrical power from said battery;

digital display means for generating digital numbers indicative of said digital signals received from said digital watch circuit means in an activated state, said digital display means disposed on said first section adjacent to said window and visible therethrough; and switch means connected between said battery and said display means for activating said display means in a closed state, said switch means further including a deformable metal pocket clip attached to said casing and connected to one terminal of said battery, and a first electrical contact disposed on said casing beneath said pocket clip, said first electrical contact comprising said switch means activating said display means when said pocket clip is deformed by finger pressure to contact said electrical contact.

12. A digital electronic watch in combination with a writing instrument comprising:

means for dispensing a marking material, said dispensing means further comprising: a casing having an open end, said casing also having an insert compartment formed therein, said insert compartment extending a predetermined distance into said casing from said open end, said casing further having window disposed between said predetermined distance and said open end;

digital watch insert means disposed in said insert compartment for generating a visual time display through said window, said insert means comprising:

at least one battery;

digital watch circuit means for generating digital signals indicative of the time and receiving electrical power from said battery;

digital display means for generating digital numbers indicative of said digital signals received from said digital watch circuit means in an activated state, said digital display means disposed adjacent said window and visible therethrough; and switch means connected between said at least one battery and said display means for activating said display means in a closed state, said switch means comprising:

a deformable metal pocket clip attached to said casing and connected to one terminal of said battery; and an electrical contact disposed on said casing beneath said pocket clip and connected to said display means;

whereby said pocket clip is deformed by finger pressure to contact said electrical contact thereby activating said display means.

* * * * *

UNITED STATES PATENT OFFICE

CERTIFICATE OF CORRECTION

Patent No. 4,215,531 Dated August 5, 1980

Inventor(s) Hon Wai Wong

It is certified that error appears in the above-identified patent and that said Letters Patent are hereby corrected as shown below:

Column 3, line 11, delete the word "mae" and insert ----made----.

Column 5, line 37, after "generating" insert ----digital----.

Column 6, line 13, after the word "insert" insert ----rigid----.

Same line, after the word "said" second occurrence, delete "rigid".

Signed and Sealed this

*Sixth* Day of *January 1981*

[SEAL]

*Attest:*

SIDNEY A. DIAMOND

*Attesting Officer*

*Commissioner of Patents and Trademarks*